United States Patent [19]

Cavalli et al.

[11] Patent Number: 4,741,644

[45] Date of Patent: May 3, 1988

[54] ENVIRONMENTAL CUT-OFF AND DRAIN

[75] Inventors: Nicholas J. Cavalli, Yonkers, N.Y.; Giosue Miotti, Carpendo, Italy

[73] Assignee: Finic, B.V., Rotterdam, Netherlands

[21] Appl. No.: 721,982

[22] Filed: Apr. 11, 1985

[51] Int. Cl.[4] ..... E02B 11/00; E02D 29/00

[52] U.S. Cl. ..... 405/50; 405/128; 405/267

[58] Field of Search ..... 405/36, 50, 128, 129, 405/267, 274, 278, 279, 281; 52/588, 589, 593, 595

[56] References Cited

U.S. PATENT DOCUMENTS

| | | | |
|---|---|---|---|
| 735,489 | 8/1903 | Friestedt | 405/281 |
| 912,020 | 2/1909 | Neilson | 405/281 |
| 2,791,886 | 5/1957 | Veder . | |
| 3,001,333 | 9/1961 | Piana | 52/595 X |
| 3,139,729 | 7/1964 | Miotti . | |
| 3,310,952 | 3/1967 | Veder . | |
| 3,412,562 | 11/1968 | Doughty . | |
| 3,422,627 | 1/1969 | Courte | 405/267 |
| 3,431,736 | 3/1969 | Ueda | 405/267 |
| 3,603,097 | 9/1971 | Zakiewicz . | |
| 3,603,099 | 9/1971 | Zakiewicz . | |
| 3,625,010 | 12/1971 | Hakundy . | |
| 3,796,054 | 3/1974 | Piccagli | 405/267 |
| 3,820,344 | 6/1974 | Caron et al. | 405/267 |
| 4,005,582 | 2/1977 | Tamaro . | |
| 4,154,041 | 5/1979 | Namy | 52/573 |
| 4,335,978 | 6/1982 | Mutch | 405/129 |
| 4,352,601 | 10/1982 | Valiga et al. | 405/270 |
| 4,358,221 | 11/1982 | Wickberg | 405/128 |
| 4,366,846 | 1/1983 | Curati . | |
| 4,375,930 | 3/1983 | Valiga | 405/128 |
| 4,379,591 | 4/1983 | Tassoney | 299/2 |
| 4,430,021 | 2/1984 | Wagner et al. | 405/129 |
| 4,439,062 | 3/1984 | Kingsbury | 405/129 |
| 4,543,016 | 9/1985 | Tallard | 405/267 |

FOREIGN PATENT DOCUMENTS

| | | | |
|---|---|---|---|
| 1484456 | 11/1969 | Fed. Rep. of Germany . | |
| 2252599 | 3/1973 | Fed. Rep. of Germany . | |
| 2944385 | 5/1981 | Fed. Rep. of Germany . | |
| 49424 | 4/1980 | Japan | 405/267 |
| 2040655 | 9/1980 | United Kingdom | 405/50 |

OTHER PUBLICATIONS

"Tensar Drainage Nets Increase Your Capacity", Tensar Corporation.

*Primary Examiner*—David H. Corbin
*Attorney, Agent, or Firm*—Jim Zegeer

[57] ABSTRACT

High density polyethylene sheets are sealed at their lateral edges to form a sheath or envelope for sandwiching a drain mesh. A plurality of spaced apart bore holes is formed along the line of the cut-off and drain barrier and a coupling member is positioned, one in each bore hole, respectively, each coupling member having at least one locking keyway slot formed in a side thereof. These coupling members have stainless steel keyway protectors or cement stops so that cementious material cast in the bore holes so as to stabilize the coupling members do not fill the keyways. After the cementious material has set, the space between bore holes up to the keyway slots is excavated including the cementious material between the facing edges of the keyway material. Then the drain barrier with rigidifying perforated pipes secured in the ends thereof is inserted into the excavated slot with the perforated pipes being telescopically received in and retained by the keyway slots. After insertion of the drain barrier, the trench is backfilled with a material such as, cement bentonite backfill.

11 Claims, 4 Drawing Sheets

POLLUTANT FLOW
C-B
C-B
DN
DN
HN
H1
H2
H3
H4
PB
PB
CSE
D
2.
2.

PF
BF
CSE
20
20
20

ENVIRONMENTAL CUT-OFF AND DRAIN

This application is related to Ressi application Ser. No. 252,676 filed Apr. 9, 1981 in which a vertical plastic sheath or envelope is provided having a drain therein and which is a continuation-in-part of Cavalli application Ser. No. 468,724 filed Feb. 22, 1983 for an Environmental Cut-off for Deep Excavations, now U.S. Pat. No. 4,601,615 and the benefit thereof is claimed under 35 USC 120.

BACKGROUND AND BRIEF DESCRIPTION OF THE INVENTION

The formation of underground impermeable barriers using slurry trench techniques have been widely developed in recent years and in a number off instances, attempts to utilize impervious plastic or rubber sheets to form impermeable barriers in such cut-off walls has been suggested, as for example, see Ranney U.S. Pat. No. 2,048,710, Zakiewicz U.S. Pat. No. 3,603,099, Piccagli U.S. Pat. No. 4,193,716 and Carron et al. U.S. Pat. No. 3,759,044. In Ressi application Ser. No. 252,676 filed Apr. 9, 1981, and assigned to the assignee hereof, a plastic sheath or envelope is provided in which permeable or porous material is in the sheath or envelope. Drainage nets sandwiched between two high density polyethylene films or geomembranes have been used in landfill, pollution control and other drainage systems. Typical drainage nets are dimensionally stable grids consisting of two sets of parallel strands with the intersecting strands forming overlayed sets of continuous drain channels to provide high flow capacity. Panelization of plastic films for insertion into vertical cut-off walls is disclosed in the above reference Cavalli application wherein a fluid barrier is constructed using pairs of spaced-apart plastic channel members with a plastic sheet sealingly joined to mutually facing surfaces thereof with slots formed in the oppositely facing surfaces for telescopically receiving rigid end pieces of intermediate plastic panel members and the sheath or double sheets of said Ressi application is also disclosed. In the above references Ressi application (also owned by the assignee hereof), the fill between the sheath is a porous drain material and self-starting pumps are embedded in perforated drain in the sheath for removing pollutants that may penetrate. As noted in the Ressi application, the pollutant barrier comprises first the excavation wall into which the bentonite has penetrated, a cake of bentonite formed on the excavation wall, a layer of high density polyethylene plastic, then the next layer of high density polyethylene plastic on the opposite side thereof and then a cake of bentonite and the earth wall that has been penetrated by the bentonite.

According to the present invention, a pollution barrier comprises a pair of substantially rectangular sheets which are sealingly joined along three edges to form a sheath or envelope and into which is inserted a drain net of the type manufactured and sold by the Tensar Corporation under the trademark Tensar. Rigid end members which, in the preferred embodiment, is perforated hollow pipe, are in the lateral ends of the envelope or sheath to rigidify the ends. The sealing of the lateral ends of the sheath can be by way of sealing to the perforated pipe. The drain net, which like all the plastic structures referred to in this specification, is preferably high density polyethylene which is substantially resistant to attach by a wide variety of chemicals.

In forming the excavation, a plurality of bore holes are spaced apart typically on 33 to 40 foot centers along the line of the pollution control barrier. A plastic coupling member, which for all intermediate bore holes has oppositely facing locking keyway slots formed therein, is inserted into the bore hole with a stainless steel blocking member, filling the slot so that upon positioning the coupling member in the bore hole and verticalizing same, the space around the coupling member is filled with a excavatable cementious material. After the excavatable cementious material has set, the earth in the space between bore holes is excavated as by a clam shell, backhoe excavator or kelly rig excavator, etc. so as to remove the soil and earth in the space therebetween all the while maintaining the excavation full of bentonite or other slurry trenching liquid material. Bentonite is preferred because it forms a mud cake on the excavation wall which serves as a barrier to pollutant flow. After the intervening soil has been excavated between a given pair of coupling elements, the steel protection members are withdrawn from the slots so as to open the keyway slots and then the plastic panel members described above are inserted with the end perforated drain pipe members fitting telescopically within the keyway slots of the coupling member. Then the space between the sidewalls and the plastic panel members is filled with a cement bentonite mixture preferrably by the tremie pipe method and the displaced bentonite is used in adjacent excavations or in forming the cement-bentonite mixtures.

The basic object of the invention is to provide an improved process and construction of underground pollution control barriers.

BRIEF DESCRIPTION OF THE DRAWINGS

The above and other objects, advantages and features of the invention will become more apparent when considered with the following specification and accompanying drawings wherein.

DETAILED DESCRIPTION

Figure 1:
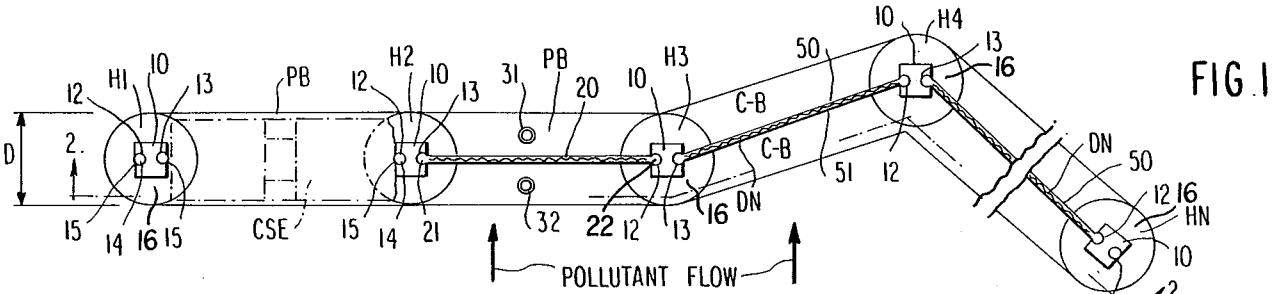
FIG. 1 is a top plan view of a pollution barrier constructed according to the present invention.
Figure 2:
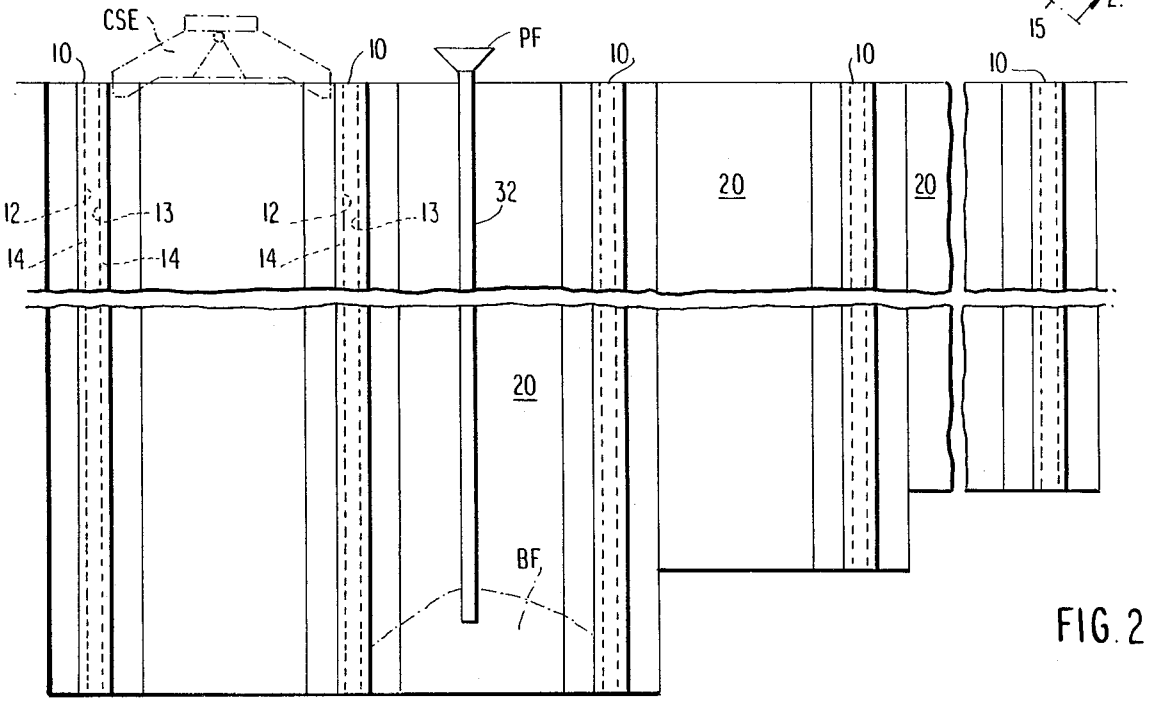
FIG. 2 is a side elevation view thereof taken in section along lines 2—2 of FIG. 1.

Referring to FIGS. 1 and 2, a series of bore holes H1, H2, H3 . . . HN is constructed along the line of the pollution control barrier PB, each bore hole, H1, H2, H3 . . . Hn having a diameter D which is substantially equal to the width of the wall and, in a typical installation, can be about 3 feet. The distance between bore holes is, typically, about 33 feet but can vary according to the terrain, possible obstructions that need to be avoided. The depth of the barrier or wall is quite large, an can extend several hundreds of feet into the earth, if desired. During the excavating the holes H1, H2 . . . HN, they are maintained full of a bentonite slurry BS. With respect to any two spaced apart bore holes, such as bore holes H2 and H3, a pair of coupling elements 10 and 11 are inserted into the bentonite filled bore holes and, as shown in coupling element 10, a pair of vertical, plastic panel keyway slots 12 and 13 are formed therein which in this embodiment have a circular section. As shown in FIGS. 1 and 2, keyway slot 12 which faces the unexcavated earth portion between holes H1 and H2 is provided with a protector block-out or cement stop member 14 which, preferrably, is a stainless steel insert which effectively fills the slot and blocks the entranceway 15 thereof so that the cementious material 16 filling hole H2, for example, does not flow into the keyway slots 12. In like manner, all of the keyway slots are provided with a cement stop such as cement stop 15 so that when the excavatable backfill cementious material 16 is inserted into the hole so as to retain the coupling members 10, 11, etc., vertical in their respective holes, no cement is permitted to enter the keyway slots. After the cementious material 16 has set or has sufficient rigidity to maintain verticality of the coupling elements during excavation of the earth between two holes H2 and H3, for example, the earth between holes is excavated, and the keyway slot protectors 15 are telescopically removed to leave an open entranceway 15. As noted above, when a pair of holes have been prepared, and a coupling member such as 10, 11 positioned therein, and the excavatable cementious material 16 placed therein, the soil between a pair of holes is excavated by a clam shell excavator, or excavating tools as is disclosed in Miotti U.S. Pat. No. 3,139,729, but modified to excavate up to removing the segment of cement at least on the opening entranceway 15 of the keyway slot which face each other in the respective bore holes H2 and H3.

Figure 5:
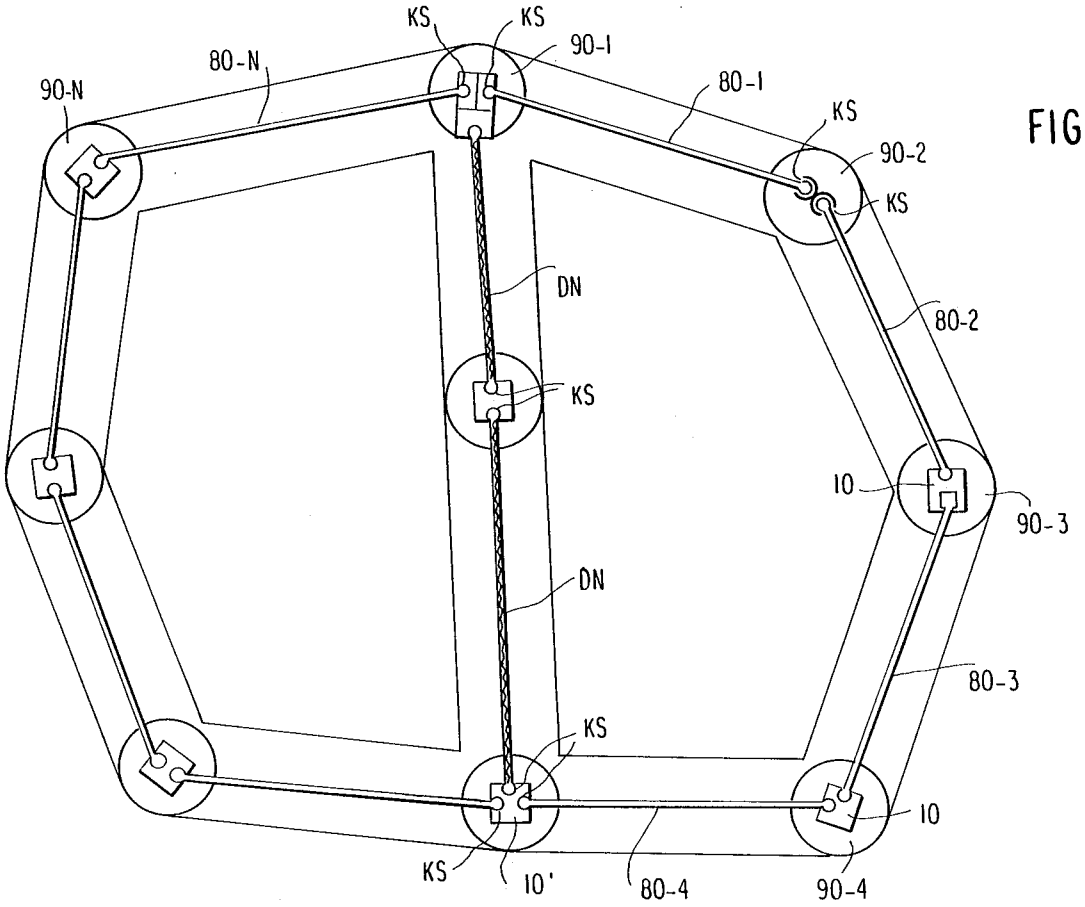
FIG. 5 is a top plan view of a pollutant control barrier constructed according to this invention.

The drainage barrier 20 with rigidifying end members 21 and 22, respectively, is then telescopically inserted in the slots 13 and 12. Thereafter, a cement bentonite mixture is inserted into the trench to displace the bentonite slurry that has been used to maintain the trench or slot open during the excavation. Preferrably, the bentonite is displaced by the cement bentonite mixture using the tremie pipe method as diagrammatically illustrated by the tremie pipes 30 and 31 in FIG. 2. This provides even loading on the drainage barrier 20 since the cement bentonite mixture has a different density than the bentonite alone. It will be appreciated that the order of forming and inserting the pollutant barrier sections is not critical and alternate ones may be formed and then the intervening spaces excavated to form the intervening control barrier units with their respective plastic drainage barrier installed. Moreover, the particular configuration of the coupling members can vary as will be illustrated more fully hereafter. Each of the vertical coupling members has coupling keyways formed therein except for the end ones which, as illustrated for a hole in HN has only one keyway slot formed therein. As illustrated in FIG. 5, the pollutant control barrier can be an endless one closing on itself. In the embodiment of FIGS. 1 and 2, each of the end rigidifying members 21 and 22 are preferrably perforated high density polyethylene pipes.

A drain barrier panel section 20 is comprised of a pair of high density polyethylene pipes or tubular drain pipe members 40 and 41 having diameters of about 6–8 inches are sealingly connected by a high density polyethylene sheet 50, 51 which, in this example, is about 60 mils thick, but which obviously can be of greater or lesser thicknesses and of any other plastic material having appropriate chemical resistance and mechanical strength properties. The lateral ends 54, 55, 56 and 57 of the high density polyethylene sheets 50–51 are sealingly bonded either to the non-perforated to the external surfaces of high density polyethylene pipes 40 and 41 or each other in an fluid impervious type manner by electronic or chemical welding, fusion or joining and sealing all of which are conventional. Each high density polyethylene sheet may be composed of several sheets which are fusingly joined or bonded at their edges to form the desired barrier but in the preferred embodiment, the single integrally formed sheet is used so as to assure that there are no leaks in the sheet. Plastic sheets 50, 51 are joined to pipes 40 and 41 at lateral edges 14 prior to telescopic insertion of same into facing key slots 12 and 13 of coupling members 12 and 13, respectively.

Once the drain barrier panel section 20 is installed, the bentonite slurry on each side of sheet 12 is displaced by a backfill which can be a mixture of soil-bentonite, cement-bentonite or concrete, etc. As shown in connection with the filling of panel section PB, the backfill is accomplished by the tremie pipe technique whereby the backfill material is hydraulically introduced into the excavation on both sides of the sheet by hollow steel tubes 31–32 which are gradually raised so that their lower ends remains within the heaps BF of backfill material on both sides of sheet 12 so that there is no differential backfill loading applied to the sheet. The lower ends of the tubes remain within the backfill heap BF and the slowing rising heap of backfill material rises upwardly and the amount of bentonite which is in the excavation thereabove is displaced and removed for storage for use in other excavating operations. The operation is terminated when the backfill material reaches the surface of the ground. A clay or concrete cap or cover may be applied at the surface of the wall.

The pipes 40 and 41 have wall thicknesses of $\frac{3}{4}$ to 1 inch. They may be cast or extruded, with or without reinforcement fibers, etc.

It will be appreciated that the trench or slot excavations can be made using any conventional slurry trench excavation technique such as a clam shell, kelly bar, rotary drill bits and even backhoed in shallower depth walls.

While in FIG. 2, there is illustrated a funnel shaped device PF for receiving the backfill material, it will be appreciated that this is purely diagrammatic as illustrating a means for supplying backfill materials for filling the trench sections on each side of the polyethylene sheets at substantially equal rates so as to avoid undue loading and distortion and stretchings of the sheet.

If there is any space between the pipes 40 and 41 and the key slots of the coupling members, a non-shrinking grout 60 can then pumped into the pipe connections or space between the outer surfaces of the pipes and the inner surfaces of the larger the keyway slots so as to form a tight joint to maintain integrity of the joint. Instead of round pipe sections, rectangular pipe sections can be utilized.

As noted earlier, the walls can go to a depth of up to about 300 feet. In the forming of the bonding of the polyethylene sheet to the rods, channel members, etc. it is good practice to first sand or roughen the surfaces and preheat same to about 120 degrees F. A bead of at least about $\frac{1}{2}$ inch or more of material provides a good impervious joint. As noted above, while it is desirable to use the same materials in forming the sheet as well as the pipe and channel members, this is not necessary. The pipe can be reinforced by fiber material such as fiberglass and the like but this is not necessary. The joint can be formed by chemical fusion or the like.

Figure 3:
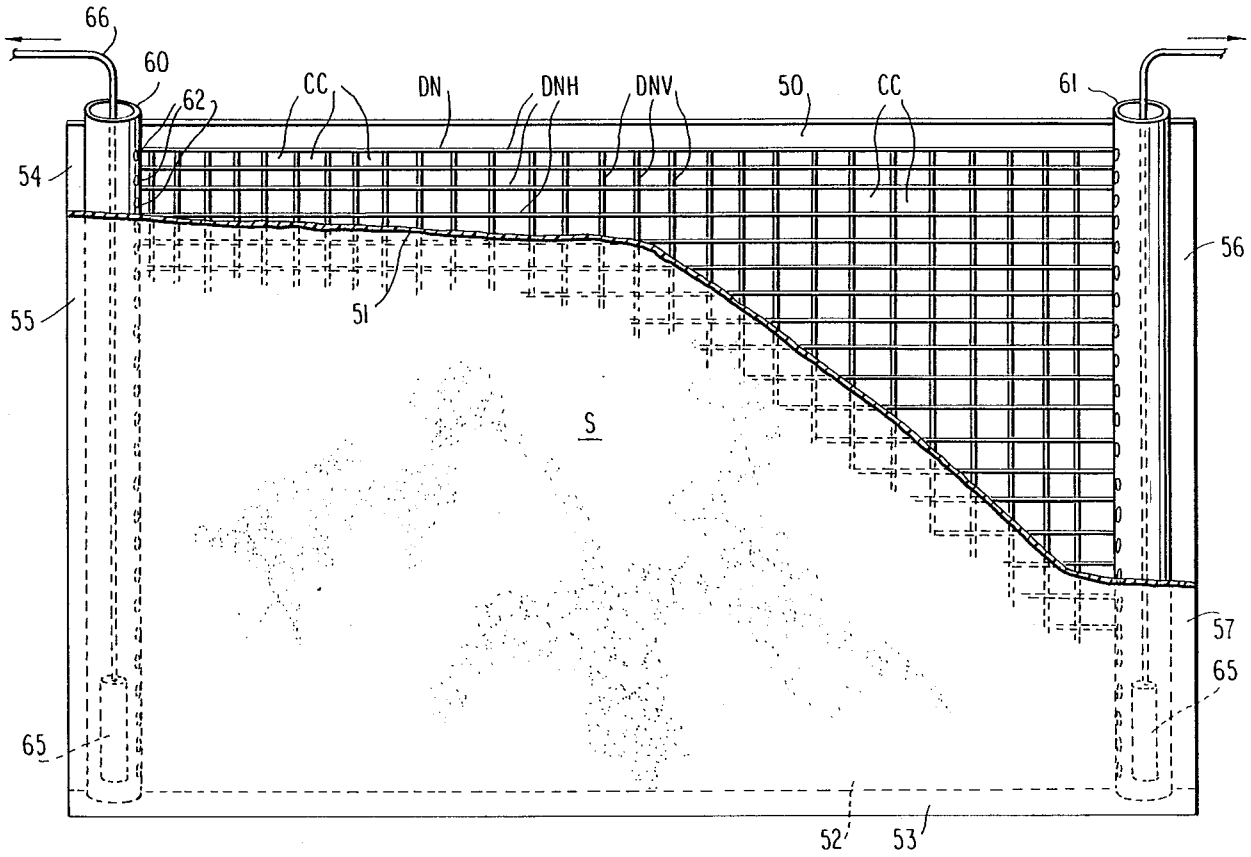
FIG. 3 is a partial cut-away view of a plastic panel section incorporating the invention.

As shown in FIG. 3, the plastic drain barrier 20 is constituted by a pair of rectangular high density sheets 50 and 51 which, typically, are 60 mils thick and have their lower ends 52, 53 sealed and their lateral ends 54, 55 and 56, 57, respectively, sealed together to form a sheath or envelope S. A drainage net DN is contained within the sheath S and is comprised of a high profile high flow capacity mesh structure manufactured from chemically inert polyethylene and, in one embodiment, can be Tensar (TM) drainage net as manufactured by the Tensar Corporation. In a preferred embodiment, such a drainage net has a thickness of approximately ¼ inch (0.25 inches) and consists of two sets of parallel strands DNH and DNV with the intersecting strands being welded or otherwise joined together to form two overlayed sets of continuous channels CC to provide the high flow capacity. Since the drainage net DN is composed of high density polyethylene, they may be easily spot welded as at SW to the plastic films 50 and 51 to maintain positional integrity. Moreover, the drainage net may be composed of several rolls of about 6 foot width with are unrolled to the full depth of the sheath S and in this disclosed embodiment where the spacing between the bore holes is about 33 feet, there are about five sections of drainage net DN. Strict verticality of the channeling CC in the drainage net is not necessary and, in fact, the drainage net can have diagonal running strands instead of horizontal DNH and vertical DNV running strands as indicated in FIG. 3. The end rigidifying members 60 and 61 are perforated plastic drain pipe and of high density polyethylene which, as indicated earlier, can be welded to the plastic sheeting 50 and 51, respectively. In FIG. 3, perforations 62, 63 in drain pipes 60, 61 face the inner portions of sheath S so as to receive the drain pollutant that may penetrate the barrier. These drain pipes 60 and 61 typically are six to eight inches in diameter and hollow throughout their length so that small diameter drain pumps 65 can be lowered into the lower ends or bottoms thereof so that any pollutant or other liquid which penetrates the drain barriers will be removed from the system via line 66. The electrical power lines (not shown) to the pump 65 can be formed as an integral part of the drain line 66.

Figure 4:
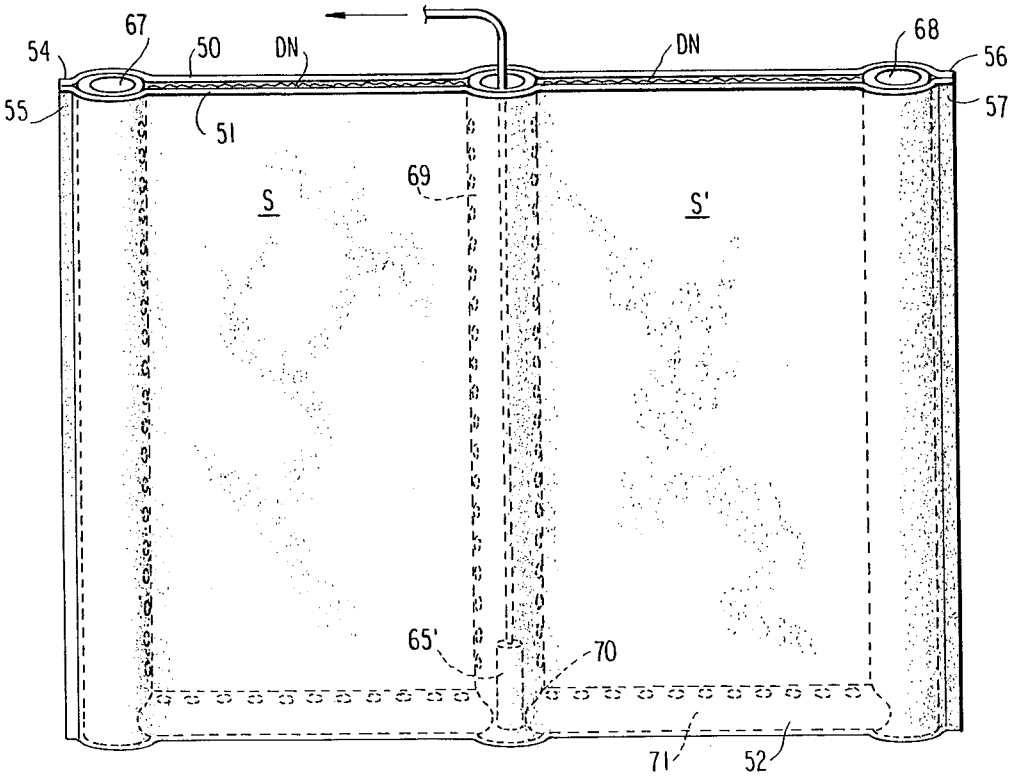
FIG. 4 is a perspective view of a modification of the invention.

In FIG. 4, the end rigidifying members are hollow or solid members 67 and 68 at the lateral ends of the sheath S'. In this case, a perforated drain pipe 7 is positioned in the lower end of the sheath S' and a centrally located perforated drain pipe 69 is joined at 70 to the lower horizontal drain pipe 71. In this case, the pump 65' is in the center drain pipe 69.

Referring now to FIG. 5, the drain net can be eliminated and in this case, the feature of coupling of the plastic panel elements utilizing the technique disclosed in FIG. 1 is utilized. In this case, the plastic panel elements 80, 81, 82 . . . 80N form a closed loop and are constructed in a manner similar to the secondary elements disclosed in the above reference Cavalli application. In this case, the coupling members 90 are positioned in the bore holes 90-1, 90-2 . . . 90-N with their respective key slots KS containing the stainless steel blockout member to protect the slot until the earth section spanning the space between two bore holes is excavated. Then the stainless steel sections are telescopically removed so as to open the slot for the insertion of the plastic panel sections. In this case, the plastic panel sections comprise end rigidifying members which are telescopically received into the keyway slots and perform in essentially the same manner as described in the above-identified Cavalli patent application. Moreover, these members may be given a slight rotational movement so as to introduce a slight taughtness in the plastic sheeting so as to eliminate wrinkles and the like. In this case, the coupling elements are retained in position initially by the filling of the excavatable cementious material about the coupling members themselves. As shown in FIG. 5, in hole 90-2, the coupling elements need not be rectangular but can be circular or, as indicated in hole 90-3, the coupling members can have rectangular keyway slots and the end rigidifying members can be rigid rectangular members for telescopic reception into the rectangular keyway slots.

While there has been shown and described herein the preferred embodiment of the invention, it will be understood that this disclosure is for the purpose of illustration and various omissions and changes in shape, proportion and arrangement of parts as well as the substitution of equivalent elements for the arrangement shown and described may be made without departing from the spirit and scope of the invention as set forth in the appended claims.

What is claimed is:

1. A method of constructing an underground drain barrier comprising, excavating a pair of spaced apart bore holes, positioning a coupling member in each bore hole, respectively, each coupling member having at least one locking keyway slot formed in an end thereof, each locking keyway having a removable cement stop member therein, casting an excavatable cementious filling in each said bore holes around said coupling member, and allowing said cementious filling to set, excavating, in the presence of liquid excavating slurry, the earth between said bore holes including the cementious filling between facing locking keyway slots, removing said removable cement stop members, positioning a plastic drain barrier in the space between said spaced apart bore holes, including sliding a pair of spaced apart hollow tubular members, perforated at least on the lower most surfaces thereof in said facing locking keyway slots, respectively, said plastic drain barrier also including a sheath constituted by a pair of plastic films sandwiching a drain mesh net therebetween, at least all underground edges of said plastic film being sealed to form a sheath.

2. The method of constructing an underground drain barrier as defined in claim 1 including backfilling the space between each plastic films of said pair and its mutually facing earth sidewall.

3. The method defined in claim 1 wherein said liquid excavating slurry is bentonite.

4. A drainage barrier for use underground comprising in combination, a pair of rectangular flexible impermeable plastic sheets, means sealing at least three adjacent edges of said flexible plastic sheets together to form a sheath, a plastic drain mesh sandwiched in said sheath between said plastic sheets, at least one perforated drain pipe in said sheath, and a pair of rigidifying members at the lateral ends of said sheath.

5. The drainage barrier defined in claim 4 wherein one of said pair of rigidifying members is hollow and perforated.

6. The drainage barrier defined in claim 5 including pump means in said hollow and perforated rigidifying member.

7. The drainage barrier defined in claim 4 wherein said drainage net is spot welded at a plurality of points to both of said pair of flexible plastic sheets.

8. A method of constructing an impervious underground barrier comprising, excavating a pair of spaced apart bore holes, positioning a coupling member in each bore hole, respectively, each coupling member having at least one locking keyway slot formed therein, each locking keyway slot having a removable cement stop member therein, casting an excavatable cementious filling in each said bore holes around said coupling member and allowing said cementious filling to set, excavating, in the presence of liquid excavating slurry, the earth between said bore holes including the cementious filling between facing locking keyway slots, removing said removable cement stop members, positioning a flexible plastic sheet barrier in the space between said spaced apart bore holes, including telescopically sliding a pair of spaced apart rigidifying plastic members in said facing keyway slots.

9. The method of constructing an impervious underground wall as defined in claim 8 including backfilling the space between each side of said flexible plastic sheet barrier with a cementious mixture.

10. Apparatus for constructing a deep, up to about 300 feet, underground fluid barrier in an elongated slot excavated in the earth comprising, a pair of vertical, spaced apart rigid plastic coupling members having mutually facing first surfaces and oppositely facing second surfaces, a plastic sheet spanning the space between said first surfaces and being substantially longer in the direction of said elongated slot than each said coupling members, said plastic sheet having lateral ends which are sealingly coupled to said mutually facing first surfaces on said rigid plastic coupling members, said rigid plastic coupling members extending for the depth of said underground barrier, and being short relative to the length of said plastic sheet in the direction of said elongated slot in the earth, and means forming a slot in each said oppositely facing surfaces of said plastic coupling members.

11. Apparatus for constructing a deep underground fluid barrier as defined in claim 10 including first and second spaced apart vertical rigid plastic secondary members, said first and second rigid plastic members having mutually facing third and fourth surfaces, respectively, said plastic sheet spanning the space between said mutually facing third and fourth surfaces and having lateral ends which are sealingly joined to said facing third and fourth surfaces, respectively, each said spaced apart rigid plastic secondary member being of a size as to be telescopically received in one of the first named pair of spaced apart channel members with said secondary flexible plastic sheet passing through said means forming a slot.

* * * * *